US010843869B1

(12) United States Patent
Rivera

(10) Patent No.: US 10,843,869 B1
(45) Date of Patent: Nov. 24, 2020

(54) RECYCLING TOTE BAG

(71) Applicant: Danny Rivera, Largo, FL (US)

(72) Inventor: Danny Rivera, Largo, FL (US)

( * ) Notice: Subject to any disclaimer, the term of this patent is extended or adjusted under 35 U.S.C. 154(b) by 0 days.

(21) Appl. No.: 16/506,468

(22) Filed: Jul. 9, 2019

(51) Int. Cl.
*B65F 1/00* (2006.01)
*B65F 1/14* (2006.01)

(52) U.S. Cl.
CPC ..... *B65F 1/0006* (2013.01); *B65F 1/004* (2013.01); *B65F 1/1452* (2013.01); *B65F 2210/167* (2013.01); *B65F 2210/18* (2013.01)

(58) Field of Classification Search
CPC ..... B65F 1/0006; B65F 1/004; B65F 1/1452; B65F 2210/167; B65F 2210/18
USPC ..... 383/23
See application file for complete search history.

(56) References Cited

U.S. PATENT DOCUMENTS 2,740,445 A * 4/1956 Fornell ..... D06F 95/004 383/22
5,050,998 A * 9/1991 Wachtel ..... D06F 95/004 150/117
5,503,476 A * 4/1996 Hamdan ..... D06F 95/002 224/585
6,478,464 B1 * 11/2002 Miller ..... B65D 31/16 224/663
6,729,519 B2 * 5/2004 Kestler ..... A45C 15/00 224/231
8,413,776 B1 * 4/2013 Huff ..... A45C 13/00 150/113
8,449,186 B2 * 5/2013 Bray ..... B65D 31/12 383/38
9,254,940 B2 * 2/2016 Bray ..... B65D 33/12
10,136,712 B2 * 11/2018 Taylor-Phillips ..... A45C 5/005
2009/0034885 A1 * 2/2009 McGruder ..... B65D 81/3446 383/37

* cited by examiner

*Primary Examiner* — Peter N Helvey
(74) *Attorney, Agent, or Firm* — Sanchelima & Associates, P.A.; Christian Sanchelima; Jesus Sanchelima

(57) ABSTRACT

A recycling tote bag including a multi-compartment assembly formed of a flexible mesh fabric adapted to store recycling items therein. The multi-compartment assembly includes at least two separated compartments for the organization of recyclable materials. The multi-compartment assembly includes a proximal fastening member on the upper edge to provide a user with access to all pockets at once. The tote bag also includes a plurality of distal fastening members each positioned along the distal end of its respective compartment. The distal fastening members allow a user to selectively empty the contents of one or more compartments individually without having to reach into the tote bag. An anchoring assembly includes an attachment member connected to at least one eyelet on the multi-compartment assembly and an anchoring member that mounts the attachment member to a structure thereby securing the recycling tote bag to trees, poles, camping equipment and the like.

7 Claims, 3 Drawing Sheets

RECYCLING TOTE BAG

BACKGROUND OF THE INVENTION

1. Field of the Invention

The present invention relates to a recycling tote bag and, more particularly, to a recycling tote bag comprising a multi-pocket satchel assembly for organizing recyclable items.

2. Description of the Related Art

Several designs for a recycling tote bag have been designed in the past. None of them, however, include a recycling tote bag comprising a multi-pocket satchel assembly formed of a flexible mesh fabric, wherein the bag is formed of three vertically elongated pockets having a zipper-like sealing means integrated in the upper proximal edge and a single zipper-like fastener positioned at the distal end of each pocket such that each pocket may be open individually from the bottom. It is known that when people attend public places such as beaches, parks, camping sites and the like there is a need to dispense recyclable items. The present invention addresses this issue by providing a recycling tote bag for the organization of recyclable items. Furthermore, the present invention includes a zipper-like sealing means integrated in the upper proximal edge to allow a user to easily access the pockets within the multi-pocket satchel assembly. Continually, the present invention provides a zipper-like fastener positioned at the distal end of each pocket of said multi-pocket satchel assembly. The zipper-like fastener is adapted to allow a user to empty the recyclable items within the multi-pocket satchel into a recycling bin.

Applicant believes that a related reference corresponds to U.S. patent 2012/0228303 that discloses a bag and a container for collecting recyclable garbage. However, it differs from the present invention because the reference fails to address the issue of providing a user a bag comprising a multi-pocket satchel assembly to organize recyclable items. Furthermore, the reference fails to provide a user with an easy and effective means of emptying the recyclable items stored within the bag. The present invention solves the issue by providing a multi-pocket satchel assembly to organize and dispose of recyclable items.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a recycling tote bag comprising a multi-pocket satchel for the organization of recyclable items to allow a user to efficiently store recyclable items and selectively deliver them to a recycling receptacle without having to put their hands in the tote.

It is another object of this invention to provide a zipper-like fastening means integrated in the upper proximal edge of the recycling tote bag that extends along the width of the bag to allow a user to access all compartments at the same time when adding or removing recyclable items. Also, the fastening means along the proximal edge can be used by a user to more easily clean all the compartments at the same time. Additionally, the proximal fastening means can be used as a back-up in case at least one of the distal fastening means fail. The proximal fastening means also secure the recyclable goods within the tote during storage and transportation.

It is still another object of the present invention to provide a zipper-like fastener positioned at the distal end of each compartment to provide a user a means of emptying recyclable items within only one compartment at a time into a corresponding recycling bin by keeping the other compartments closed while the selected compartment is opened to allow its contents to be accessed.

It is another object of the invention to include at least one throughhole on the outer surface of at least one compartment so that a user can pass an anchoring member such as a rope therethrough to attach the tote bag to a surface, vertical support element, trees, or the like.

It is yet another object of this invention to provide such a recycling tote bag that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
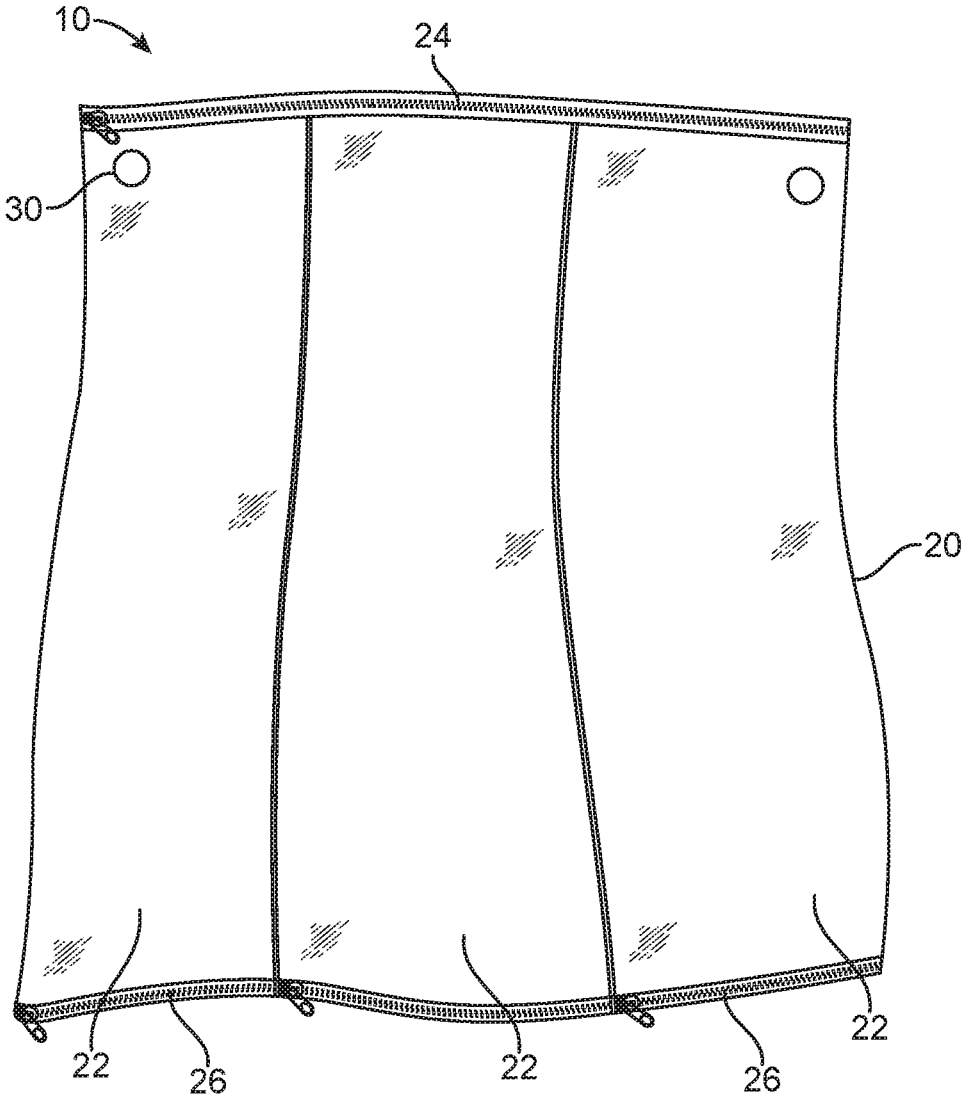
FIG. 1 represents a front view of a recycling tote bag 10 comprising of a multi-pocket satchel assembly 20, where in vertically elongated compartments 22, a proximal fastening member 24, and a plurality of distal fastening members 26 may be observed.
Figure 2:
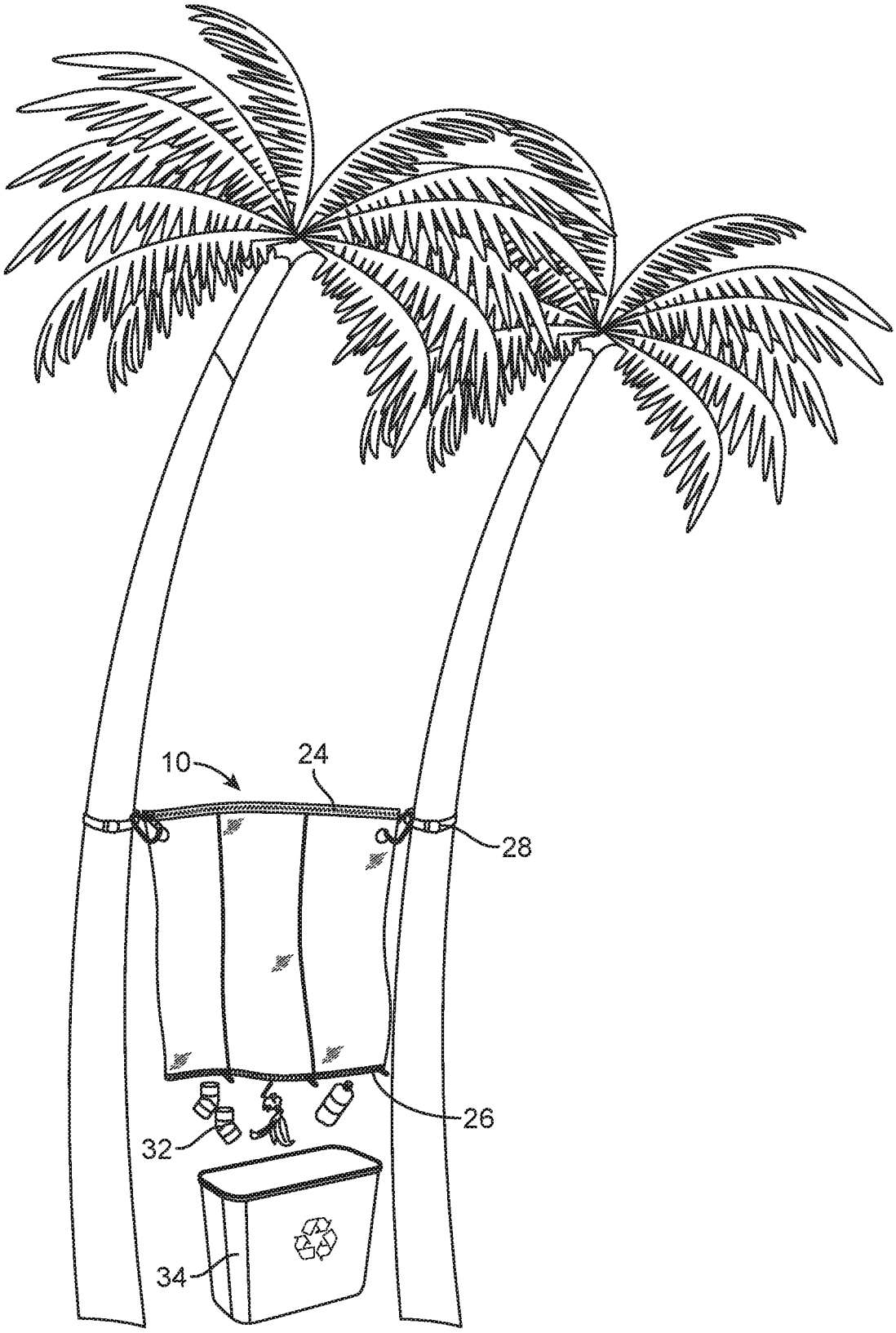
FIG. 2 shows the present invention mounted to palm trees by means of anchoring assembly 40 that includes an attachment member 42 an anchoring element 44 connected to the tote bag using eyelets 23. Furthermore, recyclable items 32 can be seen being disposed into a recycling bin 34.
Figure 3:
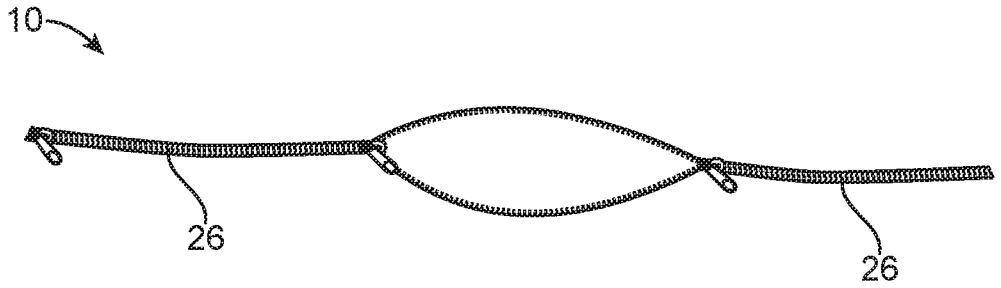
FIG. 3 illustrates a bottom view of the present invention showing the interior spaces of compartments 22 when in the open position and representing how distal fastening members 26 are attached to the present invention.
Figure 4:
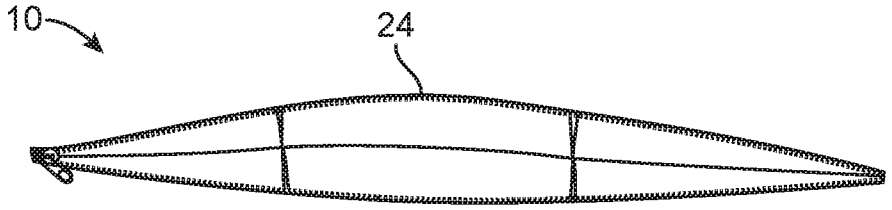
FIG. 4 shows a top view of the present invention showing the interior spaces of compartments 22 when proximal fastening member 24 is in the open position. Also, the manner in which proximal fastening member 24 is mounted to the tote bag is also shown.

Referring now to the drawings FIG. 1-4, where the present invention is generally referred to with numeral 10, it can be observed a recycling tote bag 10 includes a multi-pocket satchel assembly also known as a multi-compartment assembly 20 and anchoring assembly 40.

Multi-compartment assembly 20 includes at least two vertically elongated compartments 22, at least one eyelet 23, a proximal fastening member 24, and a plurality of distal fastening members 26. Multi-compartment assembly 20 may be made of a flexible mesh fabric or any other suitable fabric for the containing of recyclable items 32 such as plastic, paper, vinyl and the like. Compartments 22 are adapted to contain recyclable items 32 within their interior space. The embodiment depicted in FIGS. 1-4 include three vertically elongated compartments 22. However, it should be understood that multiple numbers of compartments 22 may be used with the present invention. Compartments 22 are separated vertically from each other using compartment separation members 22*a* that can include stitching, vacuum sealing, an adhesive or similar means that vertically seals each of compartments 22 from the other. Compartment separation members 22*a* keep the recyclable goods separated from each other so that a user can organize them based on type. At least one of compartments 22 can include eyelet 23 mounted thereon at a location that cooperates with the mounting of the present invention to a surface or support member. In one embodiment of the present invention, vertically elongated compartments 22 may include indicia such as "Aluminum", "Trash", and "Plastic". Additionally, such indicia may be provided in other languages such as Spanish. It is also understood that multiple indicia of multiple languages may be present on vertically elongated pockets 22 so as to encourage as many individuals of multiple backgrounds to recycle their trash. It should also be understood that additional embodiments may be provided with other indicia not limited to the ones previously disclosed.

Proximal fastening member 24 may integrated along the upper proximal edge of multi-compartment assembly 20. Proximal fastening member 24 allows the user to easily access all vertically elongated compartments 22 simultaneously. Furthermore, proximal fastening member 24 allows a user to access all three compartments at the same time for purposes of cleaning or quick release of all stored items. In one embodiment, proximal fastening member 24 can be a zipper. However, it should be understood that any sealing means may be suitable for proximal fastening member 24 such as snap buttons, hook and loop fasteners, and the like. The separation between compartments 22 created by compartment separation members 22*a* does not extend to the path of proximal fastening member 24, thereby allowing access to all compartments 22 at once.

On the opposite end of proximal fastening member 24 distal fastening members 26 are positioned along the distal edge of each corresponding compartment 22 as shown in FIG. 1. Distal fastening members 26 allow for each compartment 22 to be opened individually from the bottom of the tote bag. Additionally, distal fastening members 26 allow the user to selectively open and empty the recycling items 32 into a recycling bin 34 from one of compartments 22 at a time. The embodiment depicted in FIG. 1-4 shows that distal fastening members 26 are zippers. However, it should be understood that any sealing means may be suitable for distal fastening members 26 such as snap buttons, hook and loop fasteners, and the like. Additionally, any form of bin similar to recycling bin 34 may be used along with the present invention. Compartment separation members 22*a* extend to the distal edge of the bottom end of the tote bag to keep each distal fastening member 26 separate from the next.

Furthermore, the present invention includes an anchoring assembly 40 that includes an attachment member 42 and an anchoring member 44. Anchoring assembly 40 is used to mount recycling tote bag 10 to trees, camping equipment, vertical structures, or the like. The present embodiment depicts the recycling tote bag 10 secured to palm trees in FIG. 4. Attachment member 42 is passed through eyelet 23 and secured to anchoring member 44 that is mounted to the supporting surface, such as poles, trees, or similar objects.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A recycling tote bag, comprising:

a. a multi-compartment assembly including three vertically elongated compartments each having an interior space and separated from one another using compartment separation members, said interior space is adapted to receive and store recyclable items;

b. said recycling tote bag includes an upper edge and a lower edge, a proximal fastening member extending entirely along said upper edge and configured to provide a user with access to all three compartments at the same time;

c. three distal fastening members each one corresponding to a respective compartment and configured to selectively seal one or more of the compartments while a user accesses the contents within an opened compartment;

d. an anchoring assembly having an attachment member being a hook and an anchoring member being a strap, two of said three compartments including an eyelet near said upper edge that receives said hook, said hook is mounted to said strap, said strap is mounted to a support member, thereby connecting said recycling tote back to said support member, said support member being a tree;

e. a recycling bin located entirely below said lower edge and positioned to receive said recyclable items as they are released from one or more of said compartments; and f. said proximal fastening member and said distal fastening members being zippers.

2. The recycling tote bag of claim 1 wherein said multi-compartment assembly is rectangular in shape.

3. The recycling tote bag of claim 1 wherein said eyelet is circular in shape.

4. The recycling tote bag of claim 1 wherein said multi-compartment assembly is made of a flexible mesh fabric.

5. The recycling tote bag of claim 1 wherein said eyelet is located on a corner upper edge of the two of said three compartments.

6. The recycling tote bag of claim 1 wherein said recycling bin is rectangular in shape.

7. The recycling tote bag of claim 1 wherein said three vertically elongated compartments are adjacently aligned.

* * * * *